US008303315B2

(12) United States Patent
Lee

(10) Patent No.: US 8,303,315 B2
(45) Date of Patent: Nov. 6, 2012

(54) ELECTRICAL CONNECTOR AND ELECTRONIC ASSEMBLY HAVING A LEAD ARRANGEMENT

(75) Inventor: Sheng-Yuan Lee, Taipei Hsien (TW)

(73) Assignee: VIA Technologies, Inc., New Taipei (TW)

( * ) Notice: Subject to any disclaimer, the term of this patent is extended or adjusted under 35 U.S.C. 154(b) by 455 days.

(21) Appl. No.: 12/615,455

(22) Filed: Nov. 10, 2009

(65) Prior Publication Data

US 2011/0070751 A1 Mar. 24, 2011

(30) Foreign Application Priority Data

Sep. 18, 2009 (TW) ..... 98131588 A

(51) Int. Cl.
*H01R 12/00* (2006.01)

(52) U.S. Cl. ..... 439/79; 439/83

(58) Field of Classification Search ..... None
See application file for complete search history.

(56) References Cited

U.S. PATENT DOCUMENTS

| | | | | |
|---|---|---|---|---|
| 6,863,549 | B2 * | 3/2005 | Brunker et al. | 439/108 |
| 6,935,870 | B2 * | 8/2005 | Kato et al. | 439/108 |
| 6,953,351 | B2 * | 10/2005 | Fromm et al. | 439/101 |
| 6,994,569 | B2 * | 2/2006 | Minich et al. | 439/79 |
| 7,331,800 | B2 * | 2/2008 | Winings et al. | 439/79 |
| 2006/0228912 | A1 * | 10/2006 | Morlion et al. | 439/65 |

FOREIGN PATENT DOCUMENTS

CN 101409395 4/2009

OTHER PUBLICATIONS

Chinese First Examination Report of China Application No. 200910178517.9, dated Dec. 9, 2010.

* cited by examiner

*Primary Examiner* — Michael Zarroli
(74) *Attorney, Agent, or Firm* — J.C. Patents

(57) ABSTRACT

A lead arrangement suitable for an electrical connector includes a lead lane. The lead lane includes a pair of first differential signal leads, a pair of second differential signal leads, and a ground lead positioned between the two pairs of first and second differential signal leads. Each of the first and second differential signal leads has a surface mounting segment for being soldered onto a surface pad of a circuit board. The ground lead has a via passing segment for being soldered into a through via of the circuit board.

15 Claims, 5 Drawing Sheets

ELECTRICAL CONNECTOR AND ELECTRONIC ASSEMBLY HAVING A LEAD ARRANGEMENT

CROSS-REFERENCE TO RELATED APPLICATION

This application claims the priority benefit of Taiwan application serial no. 98131588, filed on Sep. 18, 2009. The entirety of the above-mentioned patent application is hereby incorporated by reference herein and made a part of this specification.

BACKGROUND OF THE INVENTION

1. Field of the Invention

The present invention relates to an electrical connector, and more particularly, to a lead arrangement for an electrical connector, and an electrical connector and an electronic assembly having the same.

2. Description of Related Art

Universal serial bus 3.0 (USB 3.0) is a signal transmission specification developed from USB 2.0. USB 3.0 provides a transmission rate of 5 G bps, whereas traditional USB 2.0 can only provide a transmission rate of 480M bps. It has been confirmed that USB 3.0 is compatible with USB 2.0 electrical connectors, which means USB 3.0 adopts the same lead arrangement as USB 2.0 and includes additional leads for USB 3.0 function. Therefore, it is desired to develop the USB 3.0 electrical connector to meet various market needs based on the USB 2.0 electrical connector.

SUMMARY OF THE INVENTION

In one aspect, the present invention provides a lead arrangement suitable for an electrical connector. The lead arrangement includes a lead lane. The lead lane includes a pair of first differential signal leads, a pair of second differential signal leads, and a ground lead positioned between the two pairs of differential signal leads. Each of the pair of first differential signal leads and the pair of second differential signal leads includes a surface mounting segment adapted for being soldered to a surface pad of a circuit board. The ground lead includes a via passing segment adapted for being soldered into a through via of the circuit board.

In another aspect, the present invention provides an electrical connector including a metal housing, an insulating base connected to the metal housing, and a lead arrangement disposed on the insulating base. The lead arrangement includes a lead lane. The lead lane includes a pair of first differential signal leads, a pair of second differential signal leads, and a ground lead positioned between the two pairs of differential signal leads. Each of the pair of first differential signal leads and the pair of second differential signal leads includes a surface mounting segment adapted for being soldered to a surface pad of a circuit board. The ground lead includes a via passing segment adapted for being soldered into a through via of the circuit board.

In still another aspect, the present invention provides an electronic assembly including a circuit board and an electrical connector. The circuit board includes a plurality of surface pads and a plurality of through vias. The electrical connector includes a metal housing, an insulating base connected to the metal housing, and a lead arrangement disposed on the insulating base. The lead arrangement includes a lead lane. The lead lane includes a pair of first differential signal leads, a pair of second differential signal leads, and a ground lead positioned between the two pairs of differential signal leads. Each of the pair of first differential signal leads and the pair of second differential signal leads includes a surface mounting segment being soldered to a surface pad of a circuit board. The ground lead includes a via passing segment being soldered into one of the through vias of the circuit board.

In view of the foregoing, in the present invention, some pairs of critical differential signal leads of the electrical connector are soldered to the surface pads of the circuit board by surface mounting technology, thus avoiding the affection on transmission of critical signals as well as maintaining the quality of high speed signal channel.

In order to make the aforementioned and other features and advantages of the present invention more comprehensible, embodiments accompanied with figures are described in detail below.

DESCRIPTION OF THE EMBODIMENTS

Figure 1:
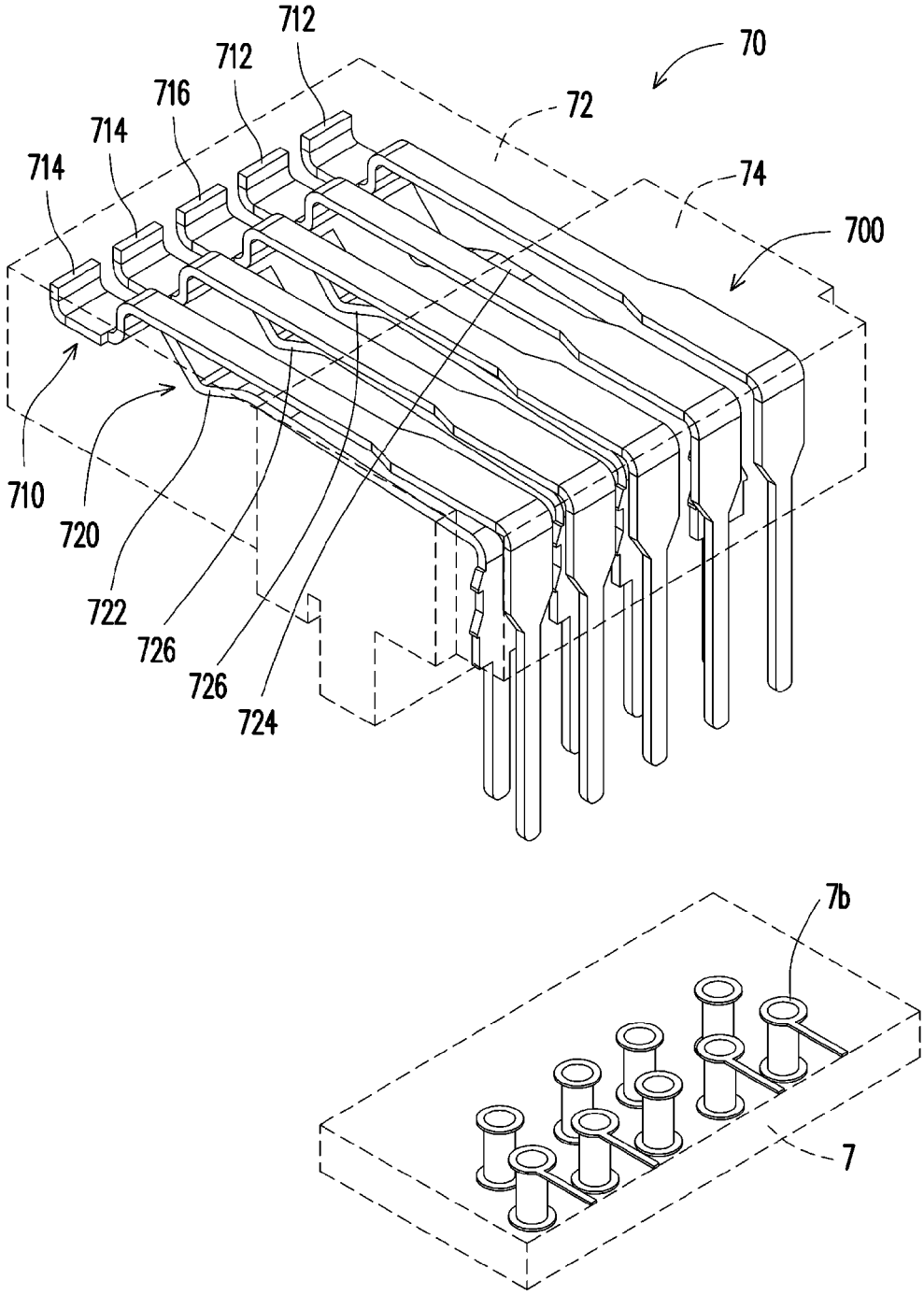
FIG. 1 and FIG. 2 illustrate a USB 3.0 electrical connector according to one embodiment of the present invention, before and after assembled to a circuit board, respectively.
Figure 2:
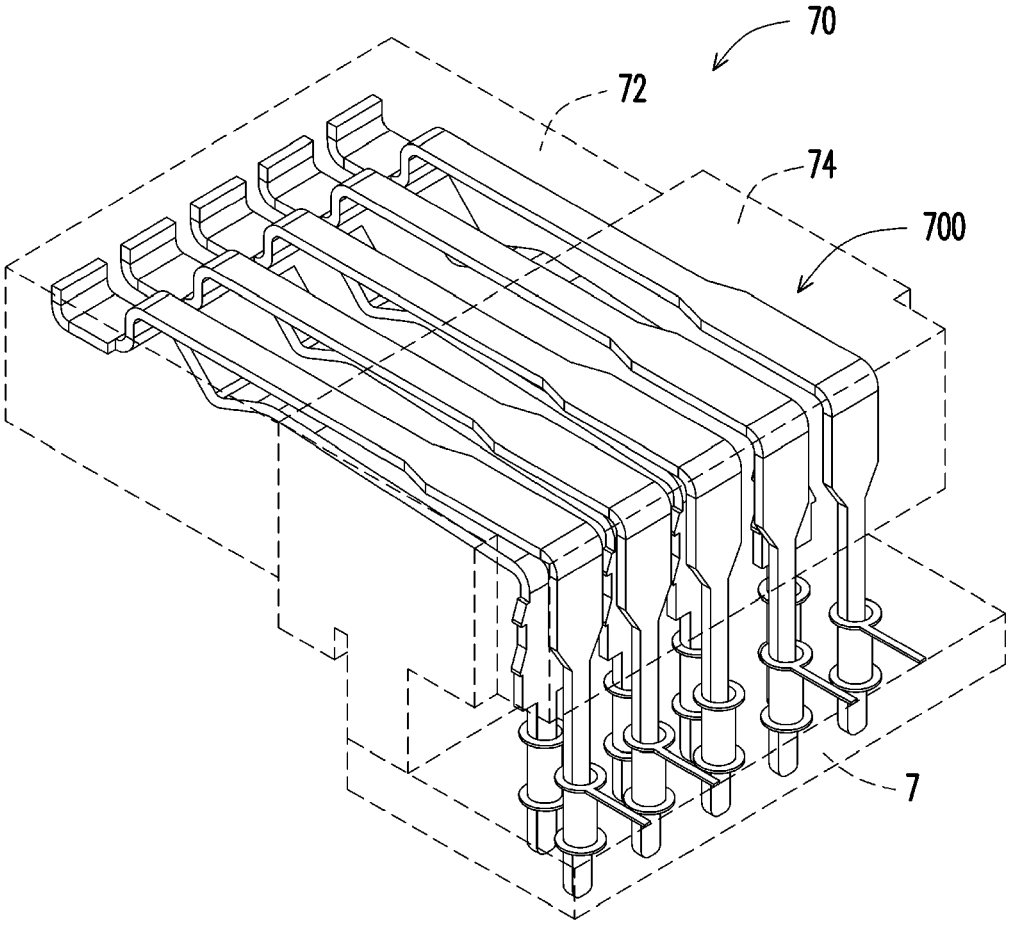

FIG. 1 and FIG. 2 illustrate a USB 3.0 electrical connector according to one embodiment of the present invention, before and after assembled to a circuit board, respectively. The electrical connector 70 of the present embodiment is suitable for being soldered to a circuit board 7 to collectively form an electronic assembly.

The electrical connector 70 includes a metal housing 72, an insulating base 74 connected to the metal housing 72, and a lead arrangement 700 disposed on the insulating base 74. The lead arrangement 700 includes a lead lane 710 and another lead lane 720 positioned side-by-side with the lead lane 710.

The lead lane 710 includes a pair of differential signal leads 712, another pair of differential signal leads 714, and a ground lead 716 positioned between the two pairs of differential signal leads 712 and 714. In the present embodiment, the pair of differential signal leads 712 is a pair of differential signal transmitting leads $T_x^+$ and $T_x^-$ in the USB 3.0 architecture, and the other pair of differential signal leads 714 is a pair of differential signal receiving leads $R_x^+$ and $R_x^-$ in the USB 3.0 architecture.

The lead lane 720 includes a ground lead 722, a power lead 724, and a pair of differential signal leads 726 positioned between the ground lead 722 and the power lead 724. In the present embodiment, the pair of differential signal leads 726 is a pair of differential signal transmitting/receiving leads $D^+$ and $D^-$ in the USB 3.0 architecture for being compatible USB 1.0 or USB 2.0 architecture.

In the USB 3.0 architecture, the differential signal transmitting leads ($T_x^+$ and $T_x^-$) and the differential signal receiving leads ($R_x^+$ and $R_x^-$) operate in a full-duplex transmission mode, i.e., both transmitting and receiving of the signals can be performed at the same time. On the other hand, the differential signal transmitting/receiving leads ($D^+$ and $D^-$) operate in a half-duplex transmission mode, i.e., transmitting and receiving of the signals can only be performed selectively, which means, data receiving is not allowed when data transmitting is being performed, or data transmitting is not allowed when data receiving is being performed.

To ensure the electrical connector 70 to be stably mounted to the circuit board 7, all the leads described above are soldered into through vias 7*b* of the circuit board 7 by passing the through vias 7*b*. In addition, in order to avoid degrading of signal propagation performance due to the parasitics aroused by the through via connected between two different metal layers of the circuit board 7, the high speed signals ($T_x^+$, $T_x^-$ and $R_X^+$, $R_x^-$) of USB 3.0 are usually distributed over the surface metal layer of the circuit board 7.

Figure 3:
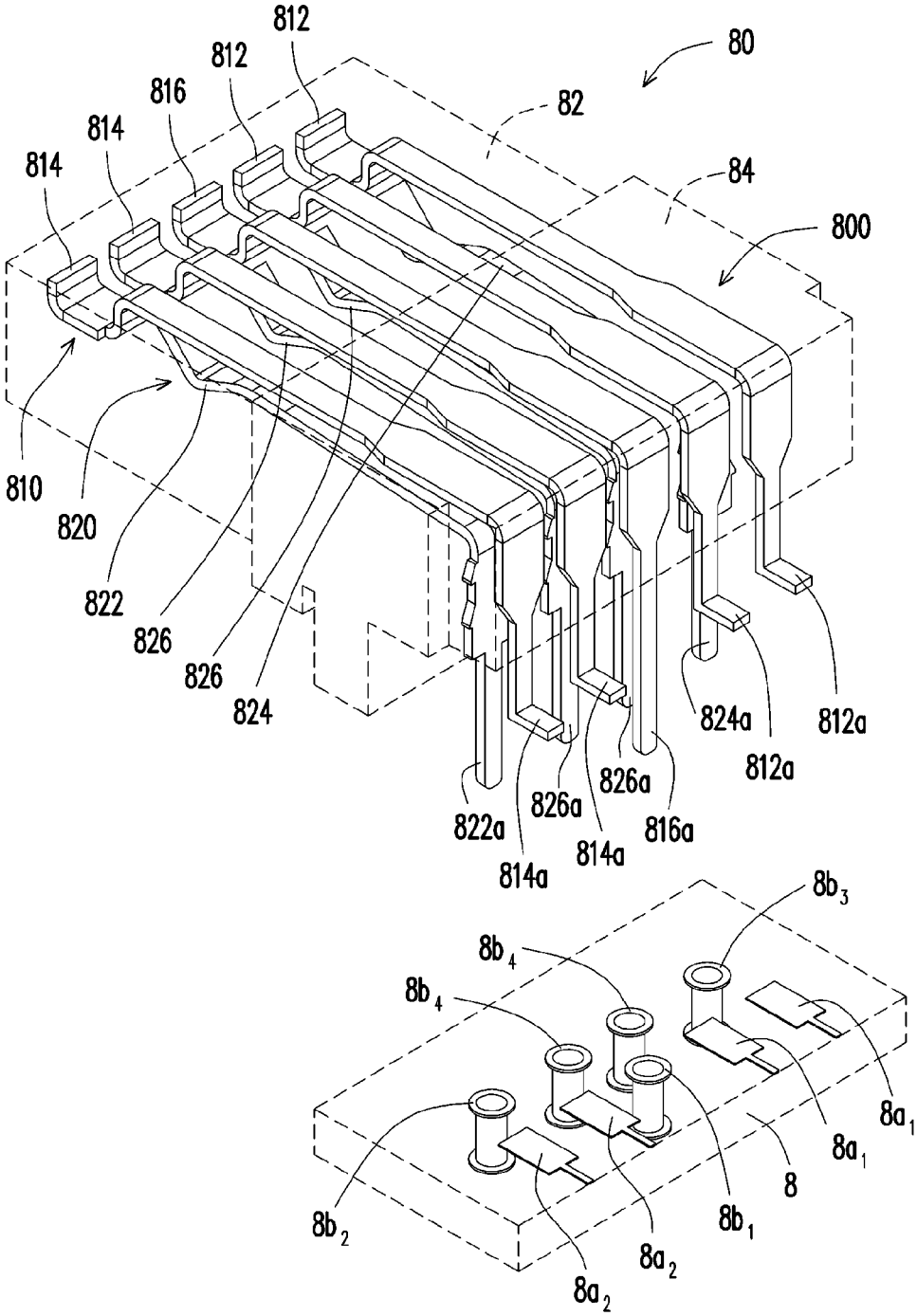
FIG. 3 and FIG. 4 illustrate a USB 3.0 electrical connector according to another embodiment of the present invention, before and after assembled to a circuit board, respectively.
Figure 4:
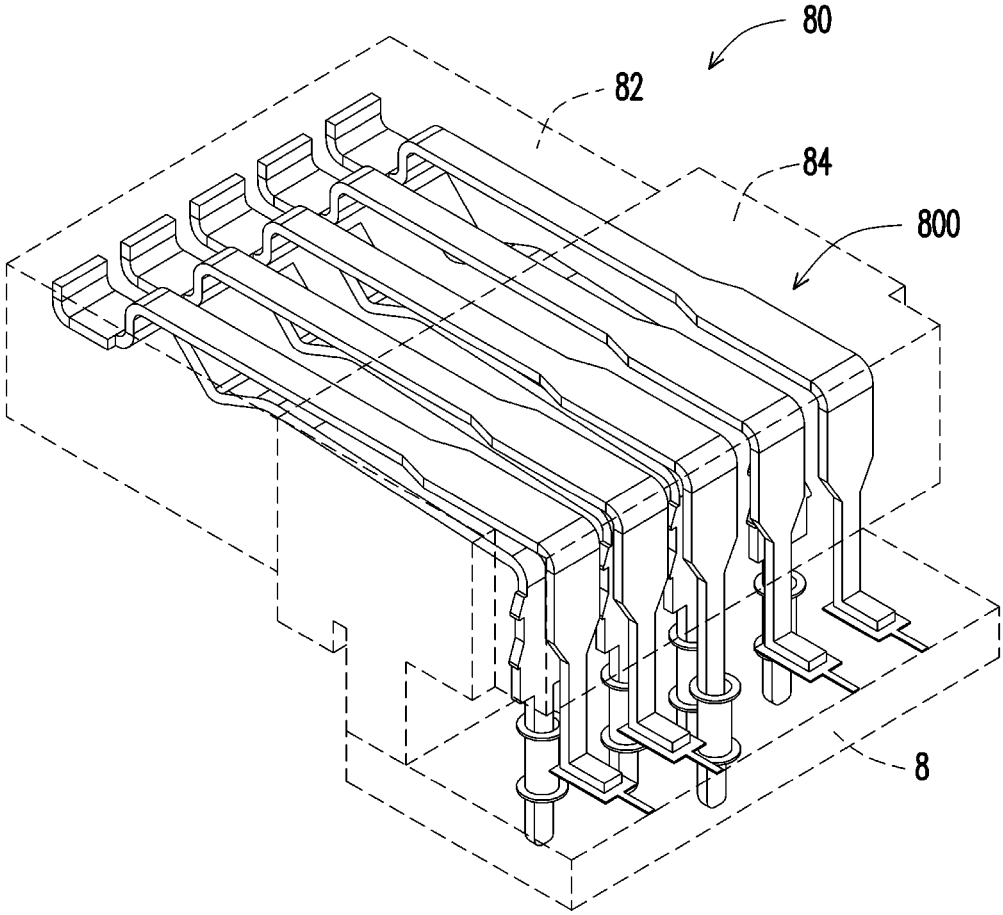

FIG. 3 and FIG. 4 illustrate a USB 3.0 electrical connector according to another embodiment of the present invention, before and after assembled to a circuit board, respectively. Referring to FIG. 3 and FIG. 4, the electrical connector 80 of the present embodiment is suitable for being soldered to a circuit board 8 to collectively form an electronic assembly.

The electrical connector 80 includes a metal housing 82, an insulating base 84 connected within the metal housing 82, and a lead arrangement 800 disposed on the insulating base 84. The lead arrangement 800 includes a lead lane 810 and another lead lane 820 positioned side-by-side with the lead lane 810.

The lead lane 810 includes a pair of differential signal leads 812, another pair of differential signal leads 814, and a ground lead 816 positioned between the two pairs of differential signal leads 812 and 814. In the present embodiment, the pair of differential signal leads 812 is a pair of differential signal transmitting leads $T_x^+$ and $T_x^-$ in the USB 3.0 architecture, and the other pair of differential signal leads 814 is a pair of differential signal receiving leads $R_x^+$ and $R_x^-$ in the USB 3.0 architecture.

Each of the pair of differential signal leads 812 includes a surface mounting segment 812*a* adapted for being soldered to a surface pad $\mathbf{8}a_1$ of the circuit board 8. Each of the pair of differential signal leads 814 includes a surface mounting segment 814*a* adapted for being soldered to a surface pad $\mathbf{8}a_2$ of the circuit board 8. The ground lead 816 includes a via passing segment 816*a* adapted for being soldered into a through via $\mathbf{8}b_1$ of the circuit board 8.

The lead lane 820 includes a ground lead 822, a power lead 824 (e.g. Vcc), and a pair of differential signal leads 826 positioned between the ground lead 822 and the power lead 824. In the present embodiment, the pair of differential signal leads 826 is a pair of differential signal transmitting/receiving leads $D^+$ and $D^-$ in the USB 3.0 architecture for supporting USB 1.0 or USB 2.0 architecture. In addition, the ground lead 822 is positioned side-by-side with and adjacent to another pair of differential signal leads 814 (e.g. the differential signal receiving leads $R_x^+$ and $R_x^-$). The power lead 824 is positioned side-by-side with and adjacent to another pair of differential signal leads 812 (e.g. the differential signal transmitting leads $T_x^+$ and $T_x^-$).

The ground lead 822 includes a via passing segment 822*a* adapted for being soldered into a through via $\mathbf{8}b_2$ of the circuit board 8. The power lead 824 includes a via passing segment 824*a* adapted for being soldered into a through via $\mathbf{8}b_3$ of the circuit board 8. Each of the pair of third differential signal leads 826 includes a via passing segment 826*a* adapted for being soldered into a through via $\mathbf{8}b_4$ of the circuit board 8.

Figure 5:
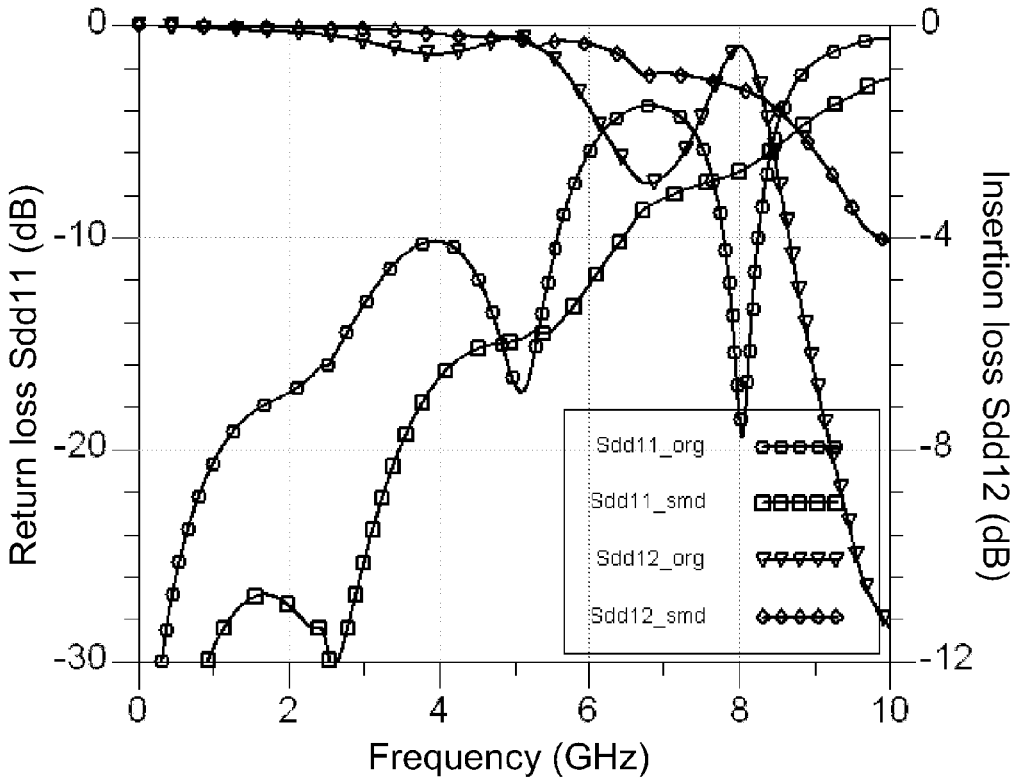
FIG. 5 illustrates a comparison between the performance of the electrical connectors assembled to the circuit boards of FIG. 2 and FIG. 4 in the USB 3.0 differential mode.

FIG. 5 illustrates a comparison between the performance of the electrical connectors assembled to the circuit boards of FIG. 2 and FIG. 4 in the USB 3.0 differential mode. Referring to FIG. 5, the signal speed of USB 3.0 is 5 Gbps and, therefore, the corresponding frequency is 2.5 GHz. Preferably, the channel performance is increased by three times of frequency, i.e. to 7.5 GHz.

From the comparison between the responses in the USB 3.0 differential mode, the differential return loss Sdd11_smd of the differential signal leads of FIG. 4 which are soldered to the circuit board by the surface mounting technology has a larger bandwidth, whereas the differential return loss Sdd11_org of the differential signal leads of FIG. 2 which are soldered to the circuit board by passing the via has a smaller bandwidth.

Along with the significant improvement on the return loss, the differential insertion loss Sdd12_smd of the present embodiment of FIG. 4 is also improved, especially in the high frequency range, in comparison with the differential insertion loss Sdd12_org of the existing structure of FIG. 2. In addition, the response ringing effect of the improved insertion loss Sdd12_smd is lower than that of the original differential insertion loss Sdd12_org.

From above description it can be clear that the structure of FIG. 4 provides a better signal channel for signal propagation than the structure of FIG. 2. This may be due to the fact that, in the electrical connector of FIG. 2, those portions of the two pairs of differential signal leads 712 and 714 (referring to FIG. 1) are disposed within the circuit board 7 and those portions of the differential signal leads 712 and 714 project out of the bottom side of the circuit board 7. Those facts may result in a large parasitic capacitance and generate a response at high frequency, thus affecting the quality of the signal channel as well as attenuating the transmitted signals.

In summary, in the present invention, some pairs of critical differential signal leads of the electrical connector are soldered to the surface pads of the circuit board by the surface mounting technology, thus avoiding the affection on propagation of critical signals as well as maintaining the quality of high speed signal channel.

In addition, in the present invention, the shape of some pairs of critical differential signal leads of the electrical connector is modified so that the signal leads can be soldered to the surface pads of the circuit board, while other components of the electrical connector can be configured in accordance with the existing USB 3.0 electrical connector. Therefore, the cost for development of the electrical connector is reduced.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A lead arrangement adapted for an electrical connector, the lead arrangement comprising:

a first lead lane comprising:

a pair of first differential signal leads;

a pair of second differential signal leads; and a first ground lead positioned between the two pairs of differential signal leads, wherein each of the pair of first differential signal leads and the pair of second differential signal leads comprises a surface mounting segment adapted for being soldered to a surface pad of a circuit board, the first ground lead comprises a via passing segment adapted for being soldered into a through via of the circuit board, the pair of first differential signal leads is a pair of differential signal transmitting leads $T_x^+$ and $T_x^-$ in a universal serial bus (USB) 3.0 architecture, and the pair of second differential signal leads is a pair of differential signal receiving leads $R_x^+$ and $R_x^-$ in the USB 3.0 architecture.

2. A lead arrangement adapted for an electrical connector, the lead arrangement comprising:
a first lead lane comprising:
a pair of first differential signal leads;
a pair of second differential signal leads; and
a first ground lead positioned between the two pairs of differential signal leads; and
a second lead lane positioned side-by-side with the first lead lane, the second lead lane comprising:
a second ground lead;
a power lead; and
a pair of third differential signal leads positioned between the second ground lead and the power lead,
wherein each of the pair of first differential signal leads and the pair of second differential signal leads comprises a surface mounting segment adapted for being soldered to a surface pad of a circuit board, the first ground lead comprises a via passing segment adapted for being soldered into a through via of the circuit board, each of the second ground lead, the power lead, and the pair of third differential signal leads comprises another via passing segment adapted for being soldered into another through via of the circuit board.

3. The lead arrangement according to claim 2, wherein the pair of third differential signal leads is a pair of differential signal transmitting/receiving leads $D^+$ and $D^-$ in the USB 3.0 architecture for being compatible USB 1.0 architecture or USB 2.0 architecture.

4. The lead arrangement according to claim 2, wherein the pair of first differential signal leads is a pair of differential signal transmitting leads $T_x^+$ and $T_x^-$ in the USB 3.0 architecture, and the power lead is positioned side-by-side with and adjacent to the pair of differential signal transmitting leads $T_x^+$ and $T_x^-$.

5. The lead arrangement according to claim 2, wherein the pair of second differential signal leads is a pair of differential signal receiving leads $R_x^+$ and $R_x^-$ in the USB 3.0 architecture, and the second ground lead is positioned side-by-side with and adjacent to the differential signal receiving leads $R_x^+$ and $R_x^-$.

6. An electrical connector comprising:
a metal housing;
an insulating base connected to the metal housing; and
a lead arrangement disposed on the insulating base, the lead arrangement comprising:
a first lead lane comprising:
a pair of first differential signal leads;
a pair of second differential signal leads; and
a first ground lead positioned between the two pairs of differential signal leads,
wherein each of the pair of first differential signal leads and the pair of second differential signal leads comprises a surface mounting segment adapted for being soldered to a surface pad of a circuit board, the first ground lead comprises a via passing segment adapted for being soldered into a through via of the circuit board, the pair of first differential signal leads is a pair of differential signal transmitting leads $T_x^+$ and $T_x^-$ in a USB 3.0 architecture, and the pair of second differential signal leads is a pair of differential signal receiving leads $R_x^+$ and $R_x^-$ in the USB 3.0 architecture.

7. An electrical connector comprising:
a metal housing;
an insulating base connected to the metal housing; and
a lead arrangement disposed on the insulating base, the lead arrangement comprising:
a first lead lane comprising:
a pair of first differential signal leads;
a pair of second differential signal leads; and
a first ground lead positioned between the two pairs of differential signal leads; and
a second lead lane positioned side-by-side with the first lead lane, the second lead lane comprising:
a second ground lead;
a power lead; and
a pair of third differential signal leads positioned between the second ground lead and the power lead,
wherein each of the pair of first differential signal leads and the pair of second differential signal leads comprises a surface mounting segment adapted for being soldered to a surface pad of a circuit board, the first ground lead comprises a via passing segment adapted for being soldered into a through via of the circuit board, each of the second ground lead, the power lead, and the pair of third differential signal leads comprises another via passing segment adapted for being soldered into another through via of the circuit board.

8. The electrical connector according to claim 7, wherein the pair of third differential signal leads is a pair of differential signal transmitting/receiving leads $D^+$ and $D^-$ in the USB 3.0 architecture for being compatible USB 1.0 architecture or USB 2.0 architecture.

9. The electrical connector according to claim 7, wherein the pair of first differential signal leads is a pair of differential signal transmitting leads $T_x^+$ and $T_x^-$ in the USB 3.0 architecture, and the power lead is positioned side-by-side with and adjacent to the pair of differential signal transmitting leads $T_x^+$ and $T_x^-$.

10. The lead arrangement according to claim 7, wherein the pair of second differential signal leads is a pair of differential signal receiving leads $R_x^+$ and $R_x^-$ in the USB 3.0 architecture, and the second ground lead is positioned side-by-side with and adjacent to the differential signal receiving leads $R_x^+$ and $R_x^-$.

11. An electronic assembly comprising:
a circuit board comprising a plurality of surface pads and a plurality of through vias; and
an electrical connector comprising:
a metal housing;
an insulating base connected to the metal housing; and
a lead arrangement disposed on the insulating base, the lead arrangement comprising:
a first lead lane comprising:
a pair of first differential signal leads;
a pair of second differential signal leads; and
a first ground lead positioned between the two pairs of differential signal leads,
wherein each of the pair of first differential signal leads and the pair of second differential signal leads comprises a surface mounting segment being soldered to a surface pad of a circuit board, the first ground lead comprises a via passing segment being soldered into one of the through vias of the circuit board, the pair of first differential signal leads is a pair of differential signal transmitting leads $T_x^+$ and $T_x^-$ in a USB 3.0 architecture, and the pair of second differential signal leads is a pair of differential signal receiving leads $R_x^+$ and $R_x^-$ in the USB 3.0 architecture.

12. An electronic assembly comprising:

a circuit board comprising a plurality of surface pads and a plurality of through vias; and an electrical connector comprising:

a metal housing;

an insulating base connected to the metal housing; and a lead arrangement disposed on the insulating base, the lead arrangement comprising:

a first lead lane comprising:

a pair of first differential signal leads;

a pair of second differential signal leads; and a first ground lead positioned between the two pairs of differential signal leads, and a second lead lane positioned side-by-side with the first lead lane, the second lead lane comprising:

a second ground lead;

a power lead; and a pair of third differential signal leads positioned between the second ground lead and the power lead, wherein each of the pair of first differential signal leads and the pair of second differential signal leads comprises a surface mounting segment being soldered to a surface pad of a circuit board, the first ground lead comprises a via passing segment being soldered into one of the through vias of the circuit board, each of the second ground lead, the power lead, and the pair of third differential signal leads comprises another via passing segment adapted for being soldered into another of the through vias of the circuit board.

13. The electronic assembly according to claim 12, wherein the pair of third differential signal leads is a pair of differential signal transmitting/receiving leads $D^+$ and $D^{31}$ in the USB 3.0 architecture for being compatible USB 1.0 architecture or USB 2.0 architecture.

14. The electronic assembly according to claim 12, wherein the pair of first differential signal leads is a pair of differential signal transmitting leads $T_x^+$ and $T_x^-$ in the USB 3.0 architecture, and the power lead is positioned side-by-side with and adjacent to the pair of differential signal transmitting leads $T_x^+$ and $T_x^-$.

15. The electronic assembly according to claim 12, wherein the pair of second differential signal leads is a pair of differential signal receiving leads $R_x^+$ and $R_x^-$ in the USB 3.0 architecture, and the second ground lead is positioned side-by-side with and adjacent to the differential signal receiving leads $R_x^+$ and $R_x^-$.

* * * * *